US010675645B2

(12) United States Patent
Wagner et al.

(10) Patent No.: US 10,675,645 B2
(45) Date of Patent: Jun. 9, 2020

(54) ROTARY SPRAYER HEAD

(71) Applicants: Barry Wagner, Oklahoma City, OK (US); Benjamin Glenn, Edmond, OK (US)

(72) Inventors: Barry Wagner, Oklahoma City, OK (US); Benjamin Glenn, Edmond, OK (US)

( * ) Notice: Subject to any disclaimer, the term of this patent is extended or adjusted under 35 U.S.C. 154(b) by 0 days.

(21) Appl. No.: 14/868,736

(22) Filed: Sep. 29, 2015

(65) Prior Publication Data

US 2019/0126297 A1 May 2, 2019

Related U.S. Application Data

(60) Provisional application No. 62/056,972, filed on Sep. 29, 2014.

(51) Int. Cl.

| | |
|---|---|
| ***B05B 3/04*** | (2006.01) |
| ***B05B 15/16*** | (2018.01) |
| ***B05B 3/06*** | (2006.01) |
| ***B05B 13/06*** | (2006.01) |

(52) U.S. Cl.

CPC ..... *B05B 3/0409* (2013.01); *B05B 3/06* (2013.01); *B05B 13/0636* (2013.01); *B05B 15/16* (2018.02)

(58) Field of Classification Search

CPC ..... B05B 3/005; B05B 3/0409; B05B 3/06; B05B 3/066; F28G 3/16

USPC ..... 239/256, 258

See application file for complete search history.

(56) References Cited

U.S. PATENT DOCUMENTS 4,078,727 A * 3/1978 Lingnau ..... B05B 15/652 239/247

5,947,387 A * 9/1999 Zink ..... B05B 3/066 239/227

* cited by examiner

*Primary Examiner* — Darren W Gorman

(74) *Attorney, Agent, or Firm* — Warner J. Delaune; Baker Donelson, et al.

(57) ABSTRACT

An improved sprayer head assembly is provided, comprising a swivel base; a head assembly; and a cage assembly. The head assembly is operatively attached to the swivel base, wherein the head assembly includes a head having a main passageway and at least two nozzle passageways; a first nozzle and a second nozzle fluidically and rotatably attached to the head, wherein the first and second nozzles are adjustable relative to the head to allow zero rotation of the head, maximum rotational speed of the head, or intermediate rotational speeds of the head during use. The cage assembly surrounds the head assembly for protection and is attached to the swivel base.

9 Claims, 3 Drawing Sheets

ROTARY SPRAYER HEAD

CROSS-REFERENCE TO RELATED APPLICATIONS

This application claims the benefit of and priority to U.S. Provisional Application No. 62/056,972, filed Sep. 29, 2014, by Barry Wagner and Benjamin Glenn, for "Improved Rotary Sprayer Head", and is entitled to that filing date for priority. The specification, figures, and complete disclosure of U.S. Provisional Application No. 62/056,972 are incorporated herein by specific reference for all purposes.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

1. Field of the Invention

The present invention relates to rotary sprayer heads used to clean conduits and similar equipment, and more particularly to rotary sprayer heads which can be adjusted to control the speed of rotation for variations in water pressure.

SUMMARY OF THE INVENTION

In various exemplary embodiments, an improved sprayer head assembly is provided, comprising a swivel base, a head assembly, and a cage assembly surrounding the head assembly and attached to the swivel base.

The head assembly is operatively attached to the swivel base, wherein the head assembly includes a head having a main passageway and at least two nozzle passageways; a first nozzle and a second nozzle fluidically and rotatably attached to the head, wherein the first and second nozzles are adjustable relative to the head to allow zero rotation of the head, maximum rotational speed of the head, or intermediate rotational speeds of the head during use.

The above and other objects and features of the present invention will become apparent from the drawings, the description given herein, and the appended claims.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Before the subject invention is further described, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs.

Figure 1:
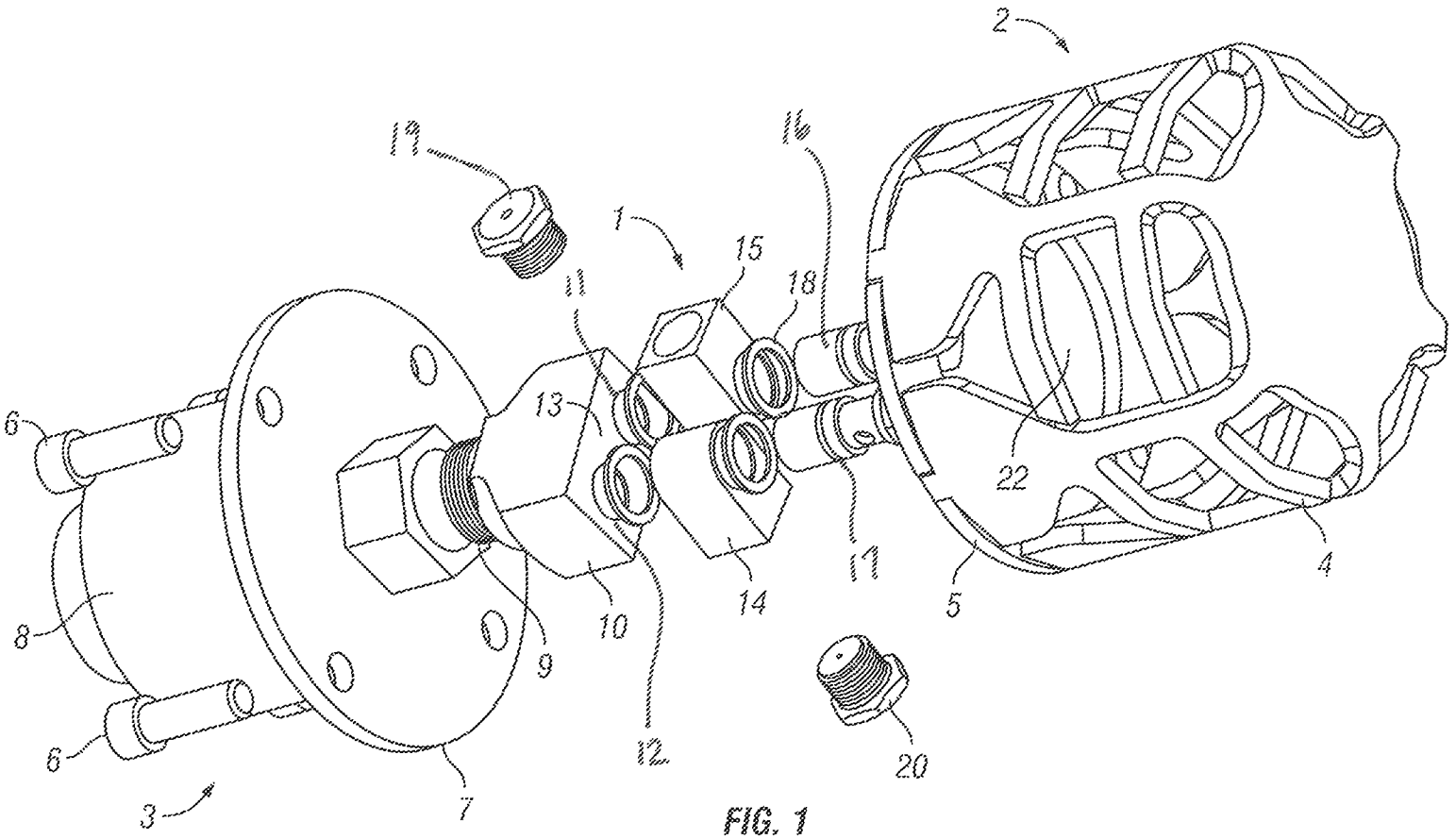
FIG. 1 shows a perspective view of the improved sprayer head assembly in a preferred embodiment.

Referring now to the drawings, and in particular FIG. 1, an improved rotary sprayer head assembly 1 and protective cage assembly 2 are generally shown. Except as otherwise indicated, all components described in this assembly are constructed from stainless steel, typically 304 or 316 stainless steel. The head assembly 1 is operatively attached to a swivel assembly 3 which allows the head assembly 1 to rotate relative to the swivel assembly 3. The swivel assembly 3 comprises a swivel base 7 and a water supply connector 8, wherein the water supply connector 8 receives a water supply.

The protective cage assembly 2 comprises a cage 4 welded to a cage base 5, and the cage base 5 is attached to the swivel assembly 3 by a plurality of bolts 6 fastened to a swivel base 7. Thus, the head assembly 1 can be easily accessed for repair or adjustment by quick removal of the cage assembly 2. The cage 4 is constructed from a folded pattern of metal first shaped from a flat pattern. When the cage 4 is folded into its final orientation, it engages the cage base 5, and welded permanently to form a single cage assembly 2. The cage base 5 has a pass-through opening 22 to allow access to the head assembly 1, such that the entire cage 4 can be easily installed and removed (without disassembly of the head assembly 1) when the head assembly 1 needs repair or adjustment. The cage 4 around the sprayer head assembly 1 must be sufficiently durable to withstand forceful contact with the surfaces that are being cleaned, and any other forces in the work environment which might damage the sprayer head assembly 1. As indicated above, the cage 4 is removable from the swivel assembly 3 to expose the head with four (4) common cap screws.

Figure 4:
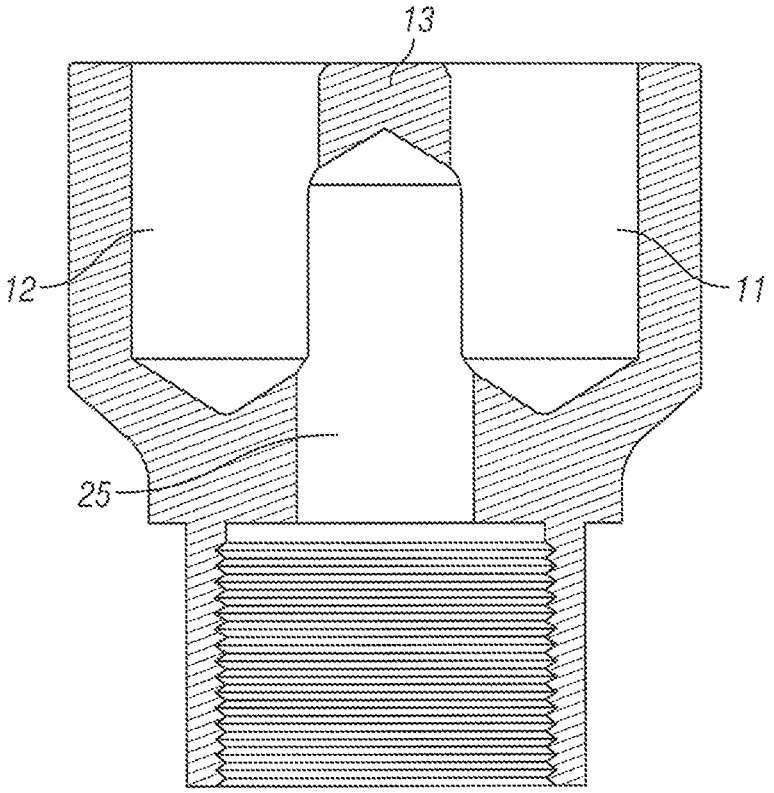
FIG. 4 is a cross-sectional view of the sprayer head and passageways.

The head assembly 1 comprises a swivel connector 9 which allows the head 10 to rotate as water is delivered through the entire assembly. To direct the pressurized water to the surfaces to be cleaned, the head 10 includes a main passageway 25 and two nozzle passageways 11, 12 (best shown in FIG. 4) opening at a nozzle mounting surface 13 which are engaged by two nozzle arms 14, 15. The nozzle arms 14, 15 direct the pressurized water outwardly from the longitudinal axis of the head 10, such that the water flows perpendicularly from the longitudinal axis of the head 10. The nozzle arms 14, 15 are adapted to rotate relative to the head 10 and are offset from one another to allow adjustment between a "zero" position (directly facing away from one another) and a "maximum" position (facing in a direction to cause a maximum speed of rotation). The nozzle arms 14, 15 are attached to the head 10 by a pair of banjo bolts 16, 17 which are threadably connected to threads inside of the passageways 11, 12. As will be appreciated, the banjo bolts 16, 17 include an orifice which allows water to flow through the nozzle arms 14, 15. Copper crush washers 18 above and below the nozzle arms 14, 15 are used to establish a seal between the head 10, banjo bolts 16, 17, and the nozzle arms 14, 15. To create the necessary pressurized streams, each of the nozzle arms 14, 15 includes a slim nozzle 19, 20 which is threadably attached to internal threads within the nozzle arms 14, 15.

Figure 2:
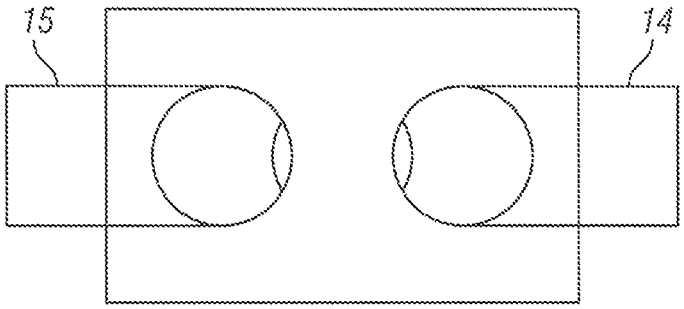
FIG. 2 shows a view of the "zero" position of the nozzle arms for no rotation.
Figure 3:
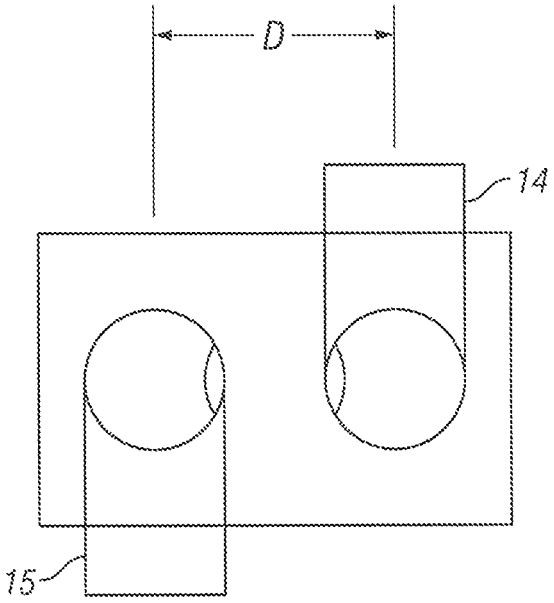
FIG. 3 shows a view of the "maximum" position of the nozzle arms for maximum rotational speed.

The improved rotary sprayer head 1 allows high pressure water leaving the nozzles 14, 15 to strike the surrounding surface perpendicularly. This action provides constant direct cleaning power at typical operating rotational speeds of 0 rpm to 3200 rpm and higher. The fully adjustable sprayer head 1 can be used down any pipe or duct having an effective diameter of about 3.25" and has no angles where the head receiver may be impinged. The sprayer head 1 may be preset for approximately 1500 rpm. To decrease the speed of the head 1, the arms 14, 15 may be set closer to parallel with the longer length of the head body 10. To increase the speed, the arms may be set closer to perpendicular with the longer length of the head body 10. But, it will be understood that the arms 14, 15 can be set at any number of positions in this range to fine tune the rotational speed of the head 10. For example, if the arms 14, 15 are set to their "zero" position as shown in FIG. 2 (parallel with the long side of the head 10), then there will be no rotation. Conversely, if the arms 14, 15 are set to their "maximum" position as shown in FIG. 3 (perpendicular to the long side of the head 10), then there will be rotation at the maximum speed. When the arms 14, 15 are in their maximum position, their respective spray axes are parallel and separated by a distance D.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only, and the scope of the present invention is to be limited only by the following claims.

The invention claimed is:

1. An improved sprayer head assembly, comprising:

(a) a fixed non-rotating base, wherein the base receives a fluid source entering the base in a first direction, and wherein the base is fixed in position relative to the fluid source;

(b) a head assembly rotatably attached to the base and in fluid communication with the fluid source through the base, wherein the head assembly includes:

a head having a main passageway and a first nozzle passageway and a second nozzle passageway, wherein the first nozzle passageway and the second nozzle passageway are parallel to the main passageway and the first direction of the fluid source;

a first nozzle and a second nozzle fluidically and rotatably attached to the head, wherein a rotational position of each of the first and second nozzles is independently adjustable relative to the head to allow zero rotation of the head, maximum rotational speed of the head, or intermediate rotational speeds of the head during use; and (c) a cage assembly surrounding the head assembly and attached to the base.

2. The assembly of claim 1, wherein the cage assembly includes a pass-through opening adapted to permit installation and removal of the cage assembly without disassembly of the head assembly.

3. The assembly of claim 1, wherein the cage assembly is removably attachable to the base by a plurality of bolts or screws.

4. The assembly of claim 1, wherein the first and second nozzle are adjustable to a position wherein each nozzle directs spray in opposite directions along the same axis.

5. The assembly of claim 1, wherein the first and second nozzle are adjustable to a position wherein each nozzle directs spray in opposite directions along different axes.

6. The assembly of claim 1, wherein the head assembly has a linear axis, and the first and second nozzle direct spray perpendicular to said linear axis.

7. The assembly of claim 1, wherein the first nozzle is positioned on a first nozzle arm, and the second nozzle is positioned on a second nozzle arm.

8. The assembly of claim 7, wherein the first nozzle arm and the second nozzle arm are fluidly connected to the first nozzle passageway and the second nozzle passageway, respectively.

9. The assembly of claim 8, wherein the first nozzle arm and the second nozzle arm are each rotatably attached to the head by a banjo bolt threadably connected to threads inside of the first and second nozzle passageways, respectively.

* * * * *